United States Patent [19]

Koch

[11] 4,023,896

[45] May 17, 1977

[54] CLEAN MARGIN MECHANISM FOR ELECTROSTATIC COPIERS

[75] Inventor: Robert M. Koch, Wheaton, Ill.

[73] Assignee: Addressograph Multigraph Corporation, Cleveland, Ohio

[22] Filed: Aug. 7, 1975

[21] Appl. No.: 602,582

[52] U.S. Cl. ..... 355/3 R; 355/7; 355/11

[51] Int. Cl.[2] ..... G03G 15/00

[58] Field of Search ..... 355/3 R, 7, 11, 16, 355/55

[56] References Cited

UNITED STATES PATENTS

| | | | |
|---|---|---|---|
| 3,724,940 | 4/1973 | Koizumi | 355/11 X |
| 3,724,942 | 4/1973 | Gibson et al. | 355/3 R |
| 3,784,301 | 1/1974 | Sato | 355/3 R X |
| 3,901,593 | 8/1975 | Kogiso et al. | 355/3 R X |
| 3,967,896 | 7/1976 | Looney et al. | 355/3 R X |

*Primary Examiner*—George H. Miller, Jr.
*Attorney, Agent, or Firm*—Russell L. Root

[57] ABSTRACT

The camera portion of a photocopy machine employs a vacuum platen type of transport for moving photoconductive sheets into exposure-position.

The sheets are of one standard size, and are normally properly filled when imaged in one-to-one size relationship with the original, but less than the full sheet is imaged whenever a reduction mode is imposed.

The photoconductive sheet is blanket charged over its entire surface before it moves to the image area and therefore, if less than the full frame is exposed, there will be large areas of residual field which will pick up toner and produce toned marginal areas, which is undesirable and wasteful. Whenever the photoconductive sheet is a master, the residual field will print the block in ink on every copy, usually rendering them unfit for use.

Accordingly, this invention is directed to the elimination of the residual field in the reduction mode of exposure by providing an automatic masking device, and a flooding of unused portions of the sheet with light energy to dissipate unwanted charge areas.

2 Claims, 2 Drawing Figures

CLEAN MARGIN MECHANISM FOR ELECTROSTATIC COPIERS

BACKGROUND OF THE INVENTION

Although most photocopy machines make a one-to-one image size with the original, more sophisticated machines are in common usage wherein the image may be reduced in size. Hence, a legal document, for instance, may be placed on a conventional 8½ × 11 sheet. There are many other reasons for size reduction.

Heretofore, the area of the sheet left unaffected by the reduced exposure required interception of the sheet before going through the fusing stage in order to wipe away the residual field, or required the use of special size masters for each size image. Either process is time-consuming and undesirable.

One teaching of a successful commercial machine which eliminates the problem of dark lateral side edges, is U.S. Pat. No. 3,685,894, which provides illumination on the edges whenever the reduced size exposure would otherwise allow the edges to remain dark and fully charged. In that prior patent, the exposure light exposes the tail end of the charged surface moving through, regardless of length.

SUMMARY OF THE INVENTION

The advantage of this invention is that a blanket charged receiving sheet, placed in a stationary exposure position, or moving and with a full frame instaneous flash, can be discharged in all border areas including the tail portion.

It is a principal object of this invention to provide a dynamic masking system coupled to the lends position in order that a flooding light may be applied to the nonimage areas of a receiving sheet without affecting the area which has been properly imaged.

More specifically, it is an object of the invention to provide a shield which will divide the exposure area into an image compartment and a light-flooding compartment, and to cause that shield to move into an area in which the lens projects a normal border around the image area. Then, by providing a flooding light in the nonimage chamber, all previously charged surfaces outside the reduced size image will be instantly rendered free of toner attracting charge.

DESCRIPTION OF THE PREFERRED EMBODIMENT

Figure 1:
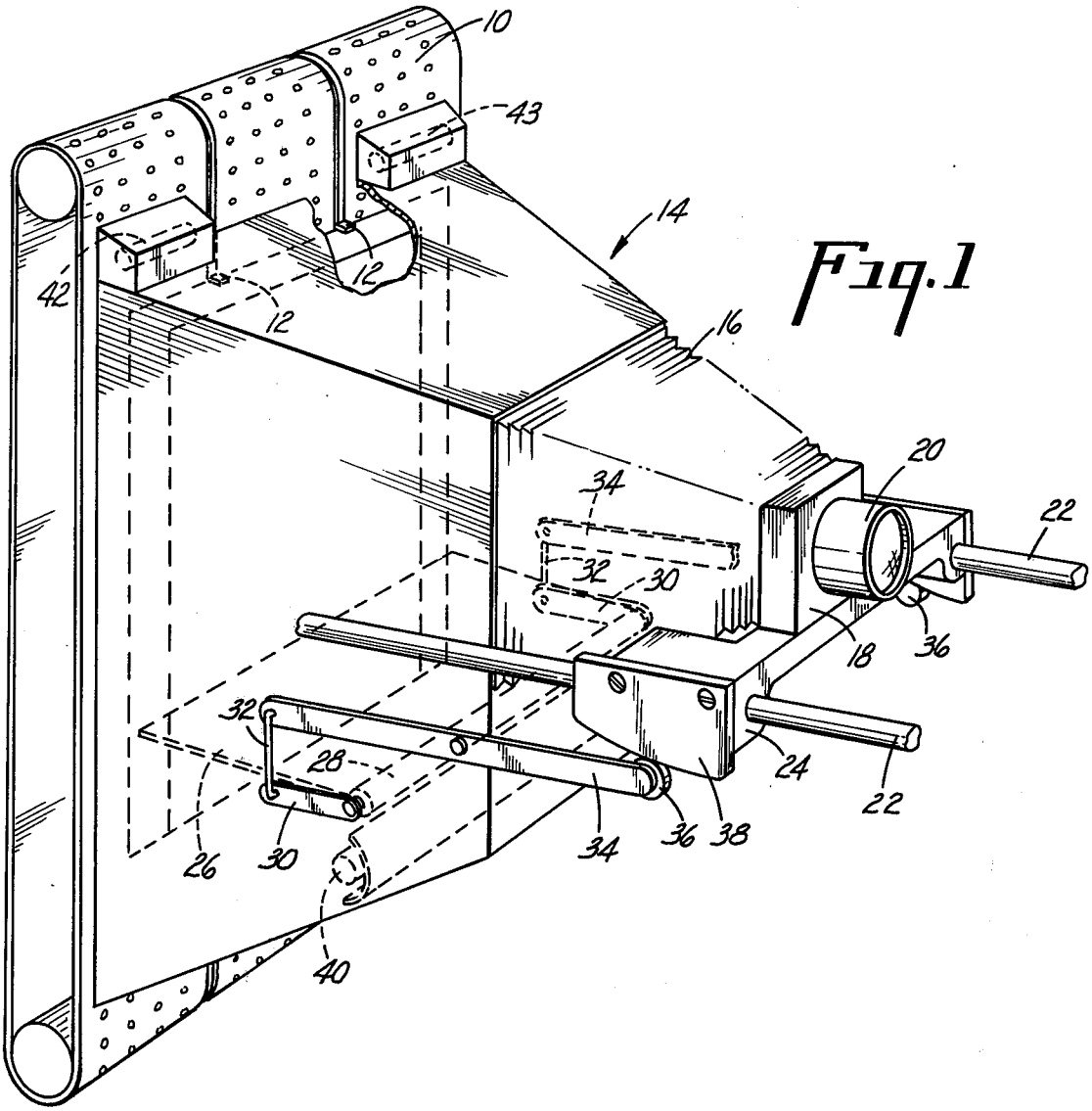
FIG. 1 is a schematic illustration of a lens system and copy transport portion of a copying machine constructed in accordance with the present invention, illustrating the dynamic shield embodiment.
Figure 2:
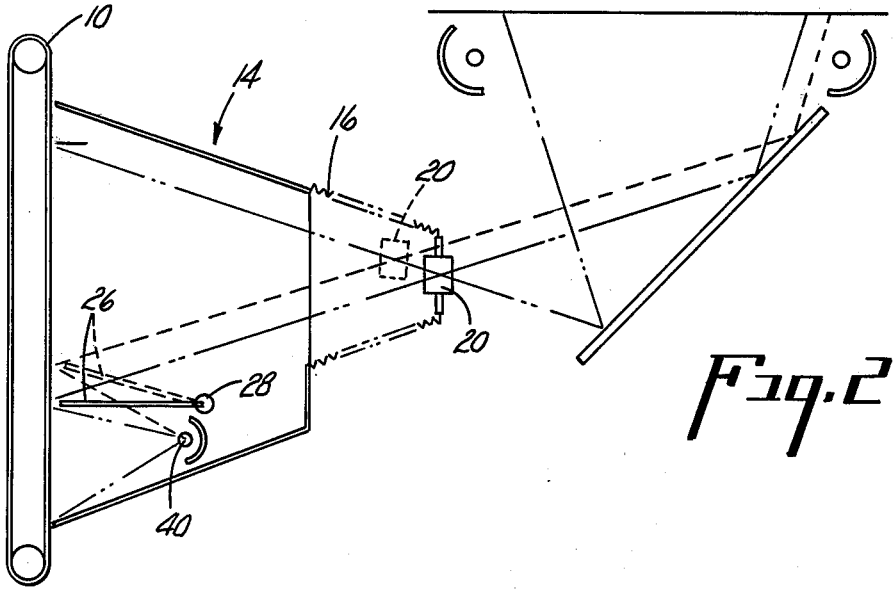
FIG. 2 is a schematic elevational view of the lens and dynamic shield in full size projection, with an overlay of the lens and shield in reduction mode.

The invention is illustrated in a simple mechanical environment, but is quite adaptable to electromechanical movement control under computer programming control.

The photocopy machine art is old and well-known, and therefore reference may be had to numerous prior art patents and the literature for complete machine design, if needed. The drawing illustrates enough of the exposure station equipment to teach the concepts of this invention.

A vacuum platen 10 is employed to receive and transport a receiving surface member into an exposure station. Although this invention may be employed for copy work, its primary intention is for making masters for the lithographic process. Such masters are generally water resistant base sheet materials having a photoconductive coating.

According to the known art, the photoconductive material is made light-sensitive by storing in darkness for some period of time. In the usual production equipment, a sheet at a time is taken from a supply depot stack and passed through a corona charging station, such as passing over a corona dischargewire as shown in U.S. Pat. No. 3,685,894, which deposits a charge on a photoconductive surface of the copy sheet. This charge is put down over the entire surface, regardless of the area to be imaged by photographic means, and will stand on the surface until the sheet becomes conductive in light-struck areas.

The blanket charged copy sheet is then transported to the vacuum platen 10 and brought to a stop by retractable stops 12 which project upwardly between individual segments of the vacuum platen 10. The stops 12 are gauges which establish the lead end position for the copy sheet. Normally, when making masters for offset printing, the master is mounted inthe printing machine from the lead edge and therefore all impression material is gauged from that lead edge. Accordingly, a reduced size imge will not be positioned around a center of the paper leaving uniform borders at the lead and tail edge as well as the sides, but rather the lead edge will be consistent regardless of the full size or reduced nature of the image, and only the lateral side and tail edges will be changed in dimension.

A housing 14 provides a chamber to shield against stray radiation which might disturb the image to be produced on the copy sheet. Normally the housing 14 and the balance of the equipment is housed within a light-tight decorative machine housing, but housing 14 is provided nevertheless as a secondary barrier against stray light.

The illustration shows a bellows 16 and lens board 18 with a lens 20 as the means for establishing the size of the image to be projected onto the copy sheet on the vacuum platen 10. In effect, the illustration is of a camera in appearance and in function.

As such camera, the lens board 18 is moved toward and away from the vacuum platen to establish the size of the image. Focusing is accomplished in standard known procedures. Position of the image in register with the lead edge is maintained by lens attitude control.

The drawing illustrates two way rods 22 which support and guide bearings 24 used to mount and transport the lens board 18.

No power devices are illustrated in the drawing, these power devices known from the art and available in many forms, including cables operating from a remote manual control and direct drive stepper motors under computer control. In the latter concept, the way rod is provided in the form of a helical screw in order to convert rotary stepper motor movement to longitudinal lens board movement.

The teaching of this invention is embodied more specifically in the provision of a baffle 26 to serve as a dynamic wall capable of moving within the housing 14 to divide the housing into first and second chambers. The first chamber is that area in which the major projection of the lens projection is encompassed. The second chamber is that area outside the desired projection area.

It is the purpose of this invention to position the baffle or shield in the normal light exposure area at the end of the image area such that the shield cuts off the projected image slightly above the end of the image. In this way, assurance is given that there is no shielded blanket charge remaining between the end of the image and the top of the shield.

The baffle 26 is shown as being mechanically coupled to the movement of the lens board 18 by the provision of a pivot support rod 28 which mounts the shield, a lever 30 in direct drive to rod 28, a link 32 connected to a rocker arm 34, and a cam follower 36 in working contact with the lower surface of a cam 38. The cam 38 is carried on the bearing and support 24 and therefore moves with the movement of the lens board. Configuration for the cam 38 is calculated to mechanically position the far end of the baffle shield dynamic wall in that areadesignated as the lower extremity of the image area projectable by the lens in any particular set location.

Then, a light 40 is provided below the shield 26 and is energized either with the exposure of the main image, or at an independent time, but will be limited to a flooding of the unused portion of the copy sheet and hence "burning out" the charge where it is not wanted at the tail end of the copy sheet.

The described apparatus leaves the problem of lateral side areas still charged and not exposed. Therefore, light boxes 42 and 43 are mounted at the top of the housing 14 and operate in the manner taught by prior U.S. Pat. No. 3,685,894. When a reduction mode of the machine is indicated, lights within the boxes are energized and illuminate the vacuum platen through slots such as shown in the prior U.S. Pat. No. 3,685,894, and after the imaging process previously described has taken place, and the stops 12 retracted, the copy sheet will advance along with vacuum platen 10 and cause the edges to be illuminated by the light escaping through the slits in the light boxes 42 and 43. Hence the remaining charge on the edges of the copy sheet is burned out also.

The copy sheet, now properly imaged and the residual fields burned away, is passed on to known types of toning and fusing stations to complete the process in the known manner.

What is claimed is:

1. A variable magnification imaging system for producing on the lead portion of a photoconductive sheet and registered with the lead edge thereof an electrostatic latent image exposure field including a centrally arranged data area while assuring a nonreproducing trailing end of the sheet, comprising:

holder means for positioning a photoconductive sheet on a receiving plane with its lead edge in a standard registry position;

movable focusing means for projecting the electrostatic latent image exposure field including the centrally arranged data area upon said plane, registered with respect to a lead edge of a sheet in said standard registry position regardless of the magnification setting of said focusing means;

shield means for dividing said receiving plane into a leading image exposure field and a trailing blanket illumination field;

means responsive to the movement of said focusing means for moving said shield means to a location coordinated with the magnification setting of said focusing means, such that the shield means divides the receiving plane at a line extending across the latent image exposure field outside of the data area and within the limit of the latent image exposure field to embrace the data area within the leading image exposure field; and means for flooding said blanket illumination exposure field with charge eliminating energy.

2. A variable magnification imaging system as set forth in claim 1 in which the means for moving the shield means comprises a cam movable in concert with the focusing means.

* * * * *